US010973345B1

(12) United States Patent
Kirk

(10) Patent No.: US 10,973,345 B1
(45) Date of Patent: Apr. 13, 2021

(54) INFLATABLE BEACH AND CAMPING PILLOW

(71) Applicant: Brian Thomas Kirk, Atlanta, GA (US)

(72) Inventor: Brian Thomas Kirk, Atlanta, GA (US)

( * ) Notice: Subject to any disclaimer, the term of this patent is extended or adjusted under 35 U.S.C. 154(b) by 0 days.

(21) Appl. No.: 16/818,045

(22) Filed: Mar. 13, 2020

(51) Int. Cl.
*A47G 9/10* (2006.01)
*A47C 16/00* (2006.01)

(52) U.S. Cl.
CPC ..... *A47G 9/1027* (2013.01); *A47C 16/00* (2013.01); *A47G 9/1045* (2013.01)

(58) Field of Classification Search
CPC .... A47G 9/1027; A47G 9/1045; A47G 9/062; A47C 16/00
See application file for complete search history.

(56) References Cited

U.S. PATENT DOCUMENTS 2,883,682 A * 4/1959 Kwake ..... A47G 9/1045 5/419
3,689,947 A * 9/1972 Wolf ..... A47G 9/1045 5/419
4,815,154 A 3/1989 Grimes
5,644,807 A * 7/1997 Battistella ..... A47G 9/062 5/419
5,774,912 A * 7/1998 Dominique ..... A47K 10/02 5/419
5,916,088 A 6/1999 Gueli
6,023,797 A * 2/2000 Brumfield ..... A47G 9/1045 383/4
6,212,716 B1 * 4/2001 Logan, Jr. ..... A47G 9/1027 383/3
6,393,638 B1 * 5/2002 MacColl ..... A45F 4/02 383/4
6,647,570 B1 * 11/2003 Ong ..... A47G 9/02 5/417
8,307,476 B1 * 11/2012 Weaver ..... A47G 9/062 5/417
8,959,679 B1 * 2/2015 Everds ..... A47G 9/062 5/419
2002/0078506 A1 * 6/2002 Sloot ..... A47C 7/021 5/644
2003/0028971 A1 * 2/2003 Chaffee ..... A47C 27/10 5/706
2004/0040088 A1 * 3/2004 Lowell ..... A47G 9/066 5/417
2005/0071920 A1 * 4/2005 Higashi ..... H01R 13/523 5/417
2006/0010598 A1 * 1/2006 Rusinak-Connors ..... A47G 9/062 5/417

(Continued)

*Primary Examiner* — Eric J Kurilla
(74) *Attorney, Agent, or Firm* — Clayton, McKay & Bailey, PC

(57) ABSTRACT

A comfortable inflatable pillow, manufactured to be affordably priced, designed to withstand the weather challenges associated with beaches, and other outdoor settings, by utilizing soft fabric that wicks away water and sheds sand, that has an attached pouch that can be filled with sand, or other weighted objects, to prevent the pillow from being blown around in windy conditions, that contains an internal pocket that can accommodate a tailor-made cooling and heating gel pack for hot or cold external temperatures, and that provides an optional incline position for added comfort when reading or surveying the landscape.

11 Claims, 6 Drawing Sheets

(56) References Cited

U.S. PATENT DOCUMENTS

| | | | | |
|---|---|---|---|---|
| 2007/0180622 | A1* | 8/2007 | Zito | B43L 1/00 5/639 |
| 2009/0151077 | A1* | 6/2009 | Heinsius | A47G 9/1045 5/639 |
| 2010/0319382 | A1* | 12/2010 | Burrini | B65D 31/147 62/259.3 |
| 2013/0312192 | A1* | 11/2013 | Lee | A47G 9/007 5/639 |
| 2015/0096908 | A1* | 4/2015 | Nadler | A47G 9/1027 206/216 |
| 2015/0342378 | A1* | 12/2015 | Boice, Jr. | A47G 9/1045 5/644 |
| 2016/0166093 | A1* | 6/2016 | Wong-Shaw | A47G 9/062 383/4 |
| 2018/0177312 | A1* | 6/2018 | Reed-Williams | A45F 4/08 |
| 2020/0288892 | A1* | 9/2020 | Esser | A47G 9/1045 |

* cited by examiner

INFLATABLE BEACH AND CAMPING PILLOW

BACKGROUND

This invention relates to a new and improved inflatable beach pillow with features that prevent it from blowing away in windy conditions, cool users down when it's hot outside and warm users up when it's cold, make it resistant to water and sand, provide an optional incline position, and allow it to be consolidated into its own integrated compact carrying pouch.

Pillows designed for use at the beach are virtually non-existent due to the saltwater and sand, windy conditions, and hot temperatures particular to coastal beach environments. Saltwater and sand will ruin cloth and cotton pillows. Because current weather-resistant inflatable pillows are so lightweight, gusts of wind blowing in off the ocean blow them away.

Existing beach pillows do not adequately address these problems. For example, U.S. Pat. No. 5,916,088 describes a pillow/headrest with a rectangular surface layer of thermally conductive gel material that becomes cold when combined with a freezer pack that is inserted into a secondary chamber recessed underneath the surface layer of gel. There are several disadvantages associated with this invention. For example, a number of problems arise from the fact that the surface layer of thermally conductive gel material is permanently incorporated into the pillow. For one, the gel material will respond to external temperatures in an undesirable way, thus conducting heat in the direct sun, and turning cold in cold temperatures. Therefore, the user is unable to control the temperature of the embedded gel pack based on external conditions and fluctuating temperatures, which could lead to unanticipated discomfort. Because the surface gel pack cannot be removed, the device will be ruined if the gel pack is punctured or damaged in such a way that causes the gel to leak out. Next, the need for a recessed chamber underneath the surface layer of gel, where the freezer pack is inserted, creates an unnecessary depression in the pillow when the freezer pack is not placed inside the chamber to fill the void, which is not optimally designed for comfort. U.S. Pat. No. 4,815,154 describes an inflatable pillow with straps that can be tied to a beach or lawn chair, and a pocket that can be filled with sand to weigh it down. However, several disadvantages are associated with this invention. For example, the construction of the pillow includes multiple panels that must be joined together, using corresponding male and female fastener elements, in order to create a cohesive structure. The pocket intended for sand is fixed in place, and secured flat against the back of the device where sand must be manually deposited inside by hand. Because the pocket is secured flat against the back of the device, it would be very difficult to completely empty all of the sand from inside the pocket, which would cause the user irritation and degrade the device over time. Lastly, a rectangular flap is attached in a position closely spaced from the open side of the pocket in an attempt to retain the sand inside the pocket, but does not provide any means of preventing sand from spilling out should the pillow be moved or carried prior to sand being emptied from the pocket.

As a result, a need exists for a new and improved pillow that will not be blown away by the wind, that can enhance the comfort of lying down in hot or cold weather by cooling the user down or warming the user up, and that can provide an optional incline position to make reading, and surveying the landscape, more comfortable and enjoyable by propping up the user's head without producing strain on the neck.

SUMMARY

In light of the foregoing disadvantages inherent in the prior art, there is a need for an outdoor pillow that can withstand the water, sand, windy conditions, and hot and cold temperatures particular to coastal beach environments in ways that are not adequately addressed by prior art. As such, the general purpose of the present invention is to provide a new and improved outdoor pillow for use at the beach, and other outdoor settings, with novel features that have all of the advantages of prior art and none of the disadvantages.

In one example, the inflatable beach and general outdoor pillow is resistant to water and sand, incorporates a pouch that can accommodate materials intended to weigh the pillow down so that the wind does not blow it away, includes an integrated sleeve designed to fit a tailor-made cooling and heating gel pack for temperature control, and features an optional incline position that will prop a user's head up to make reading and surveying the landscape more comfortable. The attached pouch, which can be filled with weighted materials to keep the pillow from blowing away in the wind, also serves as the carrying case for the pillow when the user is done using it and is ready to store it away. Once deflated, the pillow folds up into the pouch for compact storage, and convenient transport, without the need for added bags, cases, or carrying consoles.

The pillow can have an inflatable cushion, made of plastic, rubber, or another airtight and waterproof material, that can be inflated by blowing into an affixed air valve in just a few breaths, on average between three and five exhalations, and can be quickly and completely deflated for compact storage. The inflatable air cushion can be encased in a soft, comfortable fabric that repels water and sheds sand.

The inflatable pillow has an attached pouch that extends off the back of the pillow and can be used as a shovel to scoop up sand, or easily held open to receive weighted objects other than sand, such as a wireless phone, wallet, or any other such device of similar size and sufficient weight as to keep the pillow from being blown away by gusts of wind. The attached pouch is made of a slick, yet durable fabric, such as nylon, or a similar material, that easily sheds sand or other organic substances that typically cling to more porous fabrics. The opening of the pouch features a closing mechanism, such as magnetic bands, a rugged zipper, interlocking grooves, etc., that will prevent its contents from spilling out when the pillow is being moved. The pillow is constructed with a simple and intuitive clasp system for securing the pouch tightly to the pillow so as to create a single, integrated object.

To help cool the user down on a hot day, or warm the user up on a cold night, the pillow can feature an internal sleeve between the top surface layer of fabric, and a layer of fabric covering the air cushion, that can be accessed via an opening at the base edge of the pillow. This sleeve is custom designed to accommodate a tailor-made cooling and heating gel pack, and shaped to position the pack along the back of the user's neck, up to the crown of the user's head, for maximum cooling/heating relief and comfort. The position and function of this cooling and heating sleeve is clearly depicted in the drawings provided.

When lying down, it may be more comfortable to read, or look around, with one's head propped up without producing undue strain on one's neck, therefore the pillow can also feature an optional incline position that can be achieved by inflating a secondary air-bladder that angles the pillow into an incline position. There are other potential mechanisms that will allow for this incline position, which include, but are not limited to, folding a top flap, or side flaps, toward the back of the pillow to create a raised supporting base for the pillow surface to incline, as well as filling the pouch with material of sufficient size and shape to create a wedge by which the pillow can raise up into an inclined position. As such, those skilled in the art will appreciate that the examples provided establish a basis for other methods and systems that create the optional incline position that is novel to this present invention.

To make storage and transportation of the pillow easier and more efficient, the attached pouch used to weigh the pillow down in the wind can also serve as a self-contained carrying case when the pillow is not being used. When the pillow is fully deflated, it can be folded up into the pouch, which consolidates the pillow down to its most compact size, and eliminates the need for a separate carrying case.

Both the foregoing general description and the following detailed description are exemplary and explanatory only and are not restrictive of the examples, as claimed.

DETAILED DESCRIPTION OF THE DRAWINGS

Reference will now be made in detail to the present embodiments, including embodiments illustrated in the accompanying drawings. Wherever possible, the same reference numbers will be used throughout the drawings to refer to the same or like parts.

In an embodiment, the pillow can feature a primary inflatable cushion encased in a water/sand repellant fabric and incorporates an attached pouch. The attached pouch can be filled with weighted materials and also serve as the carrying case for the pillow. The opening of the attached pouch can feature a closing mechanism that prevents its contents from spilling out during movement. The pillow can be constructed with a simple and intuitive clasp system for securing the pouch tightly to the pillow, so as to create a single, integrated object.

In another embodiment, the pillow can also feature an internal sleeve, located between a top surface layer of fabric and a layer of fabric covering the air cushion, capable of accommodating a custom cooling/heating gel pack. The pillow can also feature a secondary air bladder that can be inflated via a second air valve to angle the pillow into an incline position.

Figure 1A:
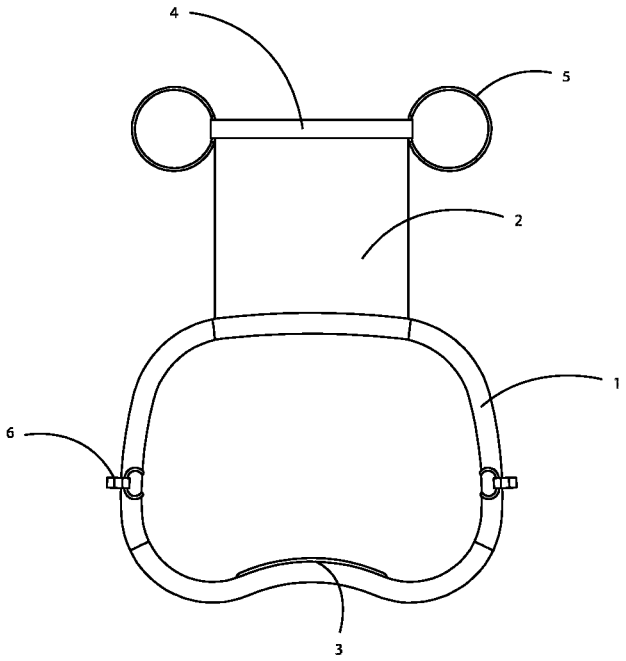
FIG. 1A is a top view of an embodiment of the pillow inflated and fully extended.
Figure 1B:
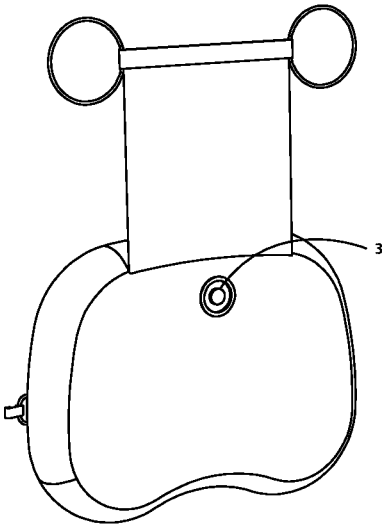
FIG. 1B is a bottom view of the pillow inflated and fully extended.

FIGS. 1A & 1B illustrate two different views of a preferred embodiment of the pillow. The pillow can comprise a pillow-shaped main body structure 1, approximately 14"× 11" in size, that utilizes an internal air-cushion made of flexible air-tight material, such as plastic or rubber, covered in a soft, polyester or microfiber fabric that wicks away water and sheds sand. There can be an opening at the base edge of the pillow 3 that allows for a tailor-made cooling and heating gel pack to be inserted into an internal pocket that positions the gel pack along the back of the user's neck, up to the crown of his or her head. A pouch 2, made of polyester, nylon, or similar slick and durable material, is attached to the back of the pillow, so that it can be used to scoop up sand, or be filled with other weighted objects that prevent the pillow from being moved by the wind or other forces, without having sand come in contact with the pillow, or the user's hand. The pouch opening 4 can be lined with plastic bands or magnetized tape, that are rigid enough to dig into sand so that the pouch can be used to scoop up sand without using one's hand, shovels, or additional devices. The pouch opening 4 can also comprise a closing mechanism, such as magnetic bands, a zipper, interlocking grooves, or the like, that prevent sand, or other enclosed objects, from spilling out. The pouch 2 can be attached to the pillow 1 with elastic bands 5 that are looped around hooked clasps 6 affixed to the side edges of the pillow, so as to create a unified structure.

The pillow of FIGS. 1A & 1B can be inflated using a sleek air valve 7 that can fully inflate the air cushion in, on average, three exhalations. The air valve 7 can have two settings to manage the flow of air. In the default setting, air is trapped inside the air cushion, and can be manually deflated by pushing a button in the center of the valve, allowing the user to incrementally adjust the amount of air inside the cushion for optimal comfort. When the button is turned 90 degrees clockwise, the air valve 7 releases all of the air within the internal air-cushion so that it can be fully deflated and conveniently stored inside the attached pouch 2, which converts into its own compact carrying case.

Figure 2:
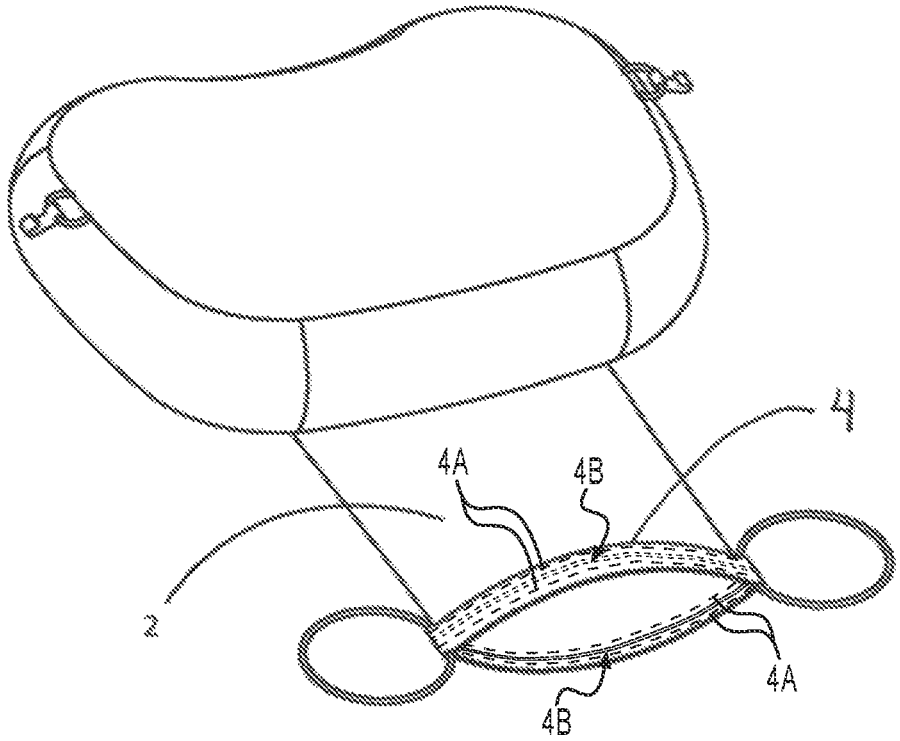
FIG. 2 is a perspective view of an embodiment of the pillow, depicting how the attached pouch can be opened and used as a scoop to scoop up sand, or filled with other weighted objects.

FIG. 2 illustrates how in one embodiment of the pillow, the attached pouch 2 can have a top lining 4 that can be opened, filled with sand or other weighted objects, and then closed. The pouch 2 can be held upright and open so that sand, or other weighted objects, such as a wireless phone, a wallet, a book, etc., can be manually inserted into the pouch 2, without said objects coming into contact with the pillow. Strong and durable rigid bands 4A can be enclosed in the top liner of the pouch 4 that can allow for the pouch to be used like a shovel to scoop up sand. These rigid bands 4A, and the orientation of the pouch, allow for sand to be scooped into the pouch without the need for additional devices, or having the sand come in contact with the pillow, or the user's hand.

The top lining 4 of the attached pouch 2 can also contain a closing mechanism 4B including interlocking grooves. In other examples, the closing mechanism can be defined by other components, such as magnetic bands, a rugged zipper, etc., that keep sand, or other weighted objects, trapped inside the pouch 2, and prevent said objects from spilling out when the pillow is purposefully moved.

Figure 3A:
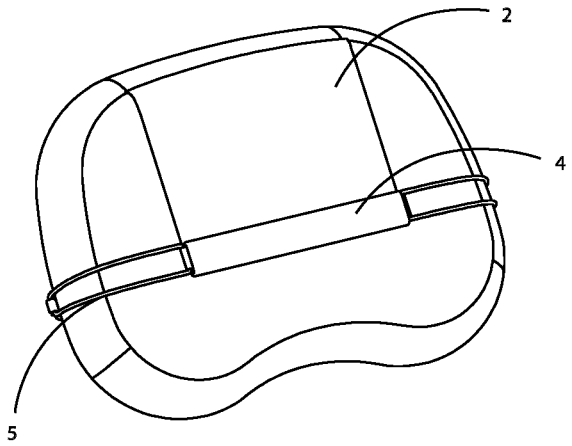
FIG. 3A is a perspective view of an embodiment of the pillow, wherein the attached pouch is closed and secured to the back of the pillow.
Figure 3B:
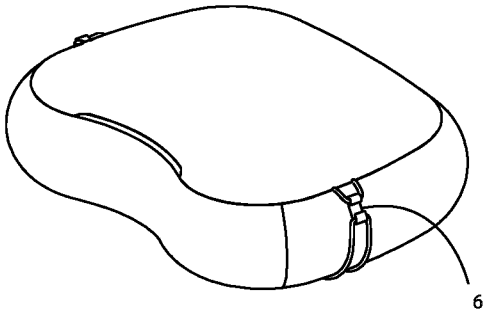
FIG. 3B is another perspective view of the pillow, wherein the attached pouch is closed and secured to the back of the pillow.

In order to create a unified, integrated pillow, the attached pouch 2, whether filled with weighted materials or empty, can be securely attached to the bottom of the pillow using elastic bands 5 and hooked clasps 6, as seen in FIGS. 3A & 3B. In a preferred embodiment of the pillow, the closing mechanism of the pouch's top lining 4 will be folded over twice to further ensure that the contents within will not accidentally spill out.

Figure 4:
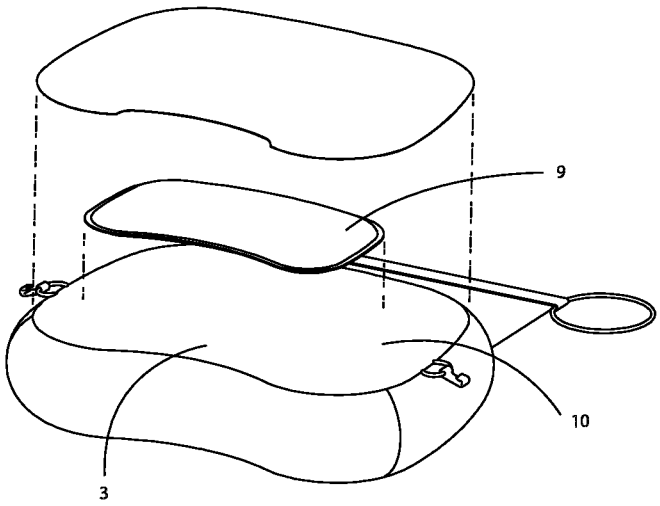
FIG. 4 is an exploded view of an embodiment of the pillow, showing the placement of a cooling/heating gel pack in a pocket created between a top layer of fabric and a bottom layer of fabric that covers the air cushion.

FIG. 4 illustrates an exploded view of another embodiment of the pillow. In this example, in order to cool a user down on a hot day, or warm a user up in colder temperatures, the pillow can contain an internal pocket 10 positioned underneath the top layer of fabric, and a bottom layer of fabric that covers the air cushion. A cooling and heating gel pack 9, that is tailor-made to fit inside the pocket, and contour to the pillow's shape, can be inserted through the opening to the pocket 3 positioned at the base edge of the pillow. This gel pack 9 can be stored on ice in a beach cooler until it is ready to be used to cool the user down, or heated in the direct sun, or safely in a bowl of hot water, to warm the user up.

Figure 5:
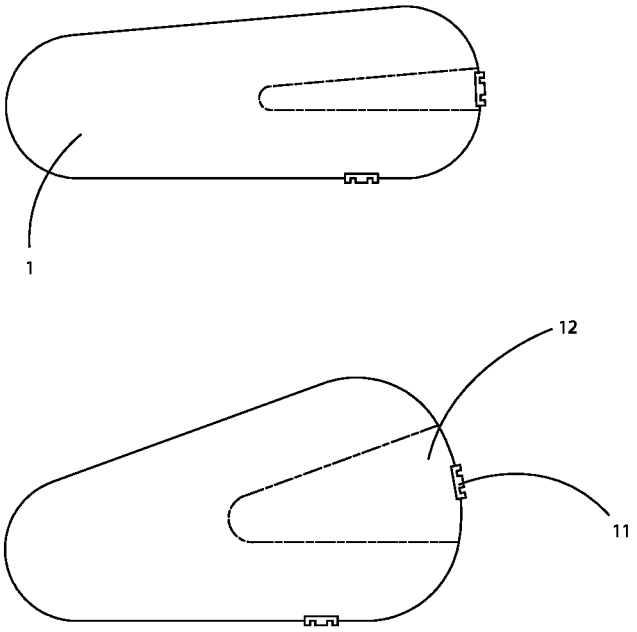
FIG. 5 is a side view of an embodiment of the pillow containing an inflated secondary air bladder.

In yet a different embodiment depicted in FIG. 5, the pillow 1 can feature two angle orientations depending on its preferred use. The pillow can possess a secondary air bladder 12 that can be located internally, as illustrated here, or externally along the bottom, which produces an optional incline angle (a minimum of approximately 25 degrees) when inflated via a second air-valve 11, thus propping up the user's head, making reading or surveying the landscape more comfortable. This optional incline position can be achieved through other measures, such as having adjustable flaps on either side of the pillow, or on the top, that can be pulled toward the back of the pillow, and secured, so as to create a wedge shape, or tri-pod effect. These incline mechanisms can be undone so that the pillow lies flat, should the user consider this a more comfortable position for sunbathing, or napping.

Figure 6:
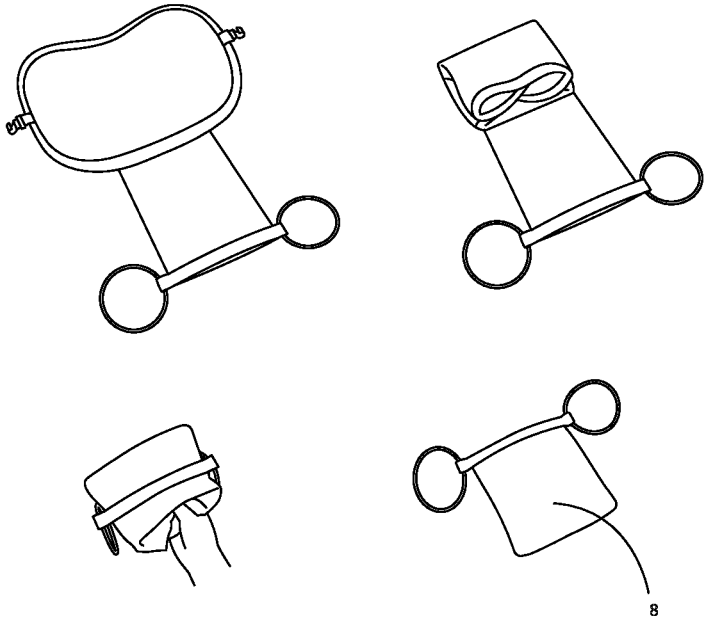
FIG. 6 is a series of illustrations depicting how an embodiment of the pillow can be folded up and fully contained in the attached pouch.

When the user is done using the pillow, the pillow can be completely deflated and folded up into the attached pouch 2, which can be effectively converted into a compact carrying case 8 for convenient storage and transportation, as depicted in FIG. 6.

Other examples of the disclosure will be apparent to those skilled in the art from consideration of the specification and practice of the examples disclosed herein. Though some of the described methods have been presented as a series of steps, it should be appreciated that one or more steps can occur simultaneously, in an overlapping fashion, or in a different order. The order of steps presented are only illustrative of the possibilities and those steps can be executed or performed in any suitable fashion. Moreover, the various features of the examples described here are not mutually exclusive. Rather, any feature of any example described here can be incorporated into any other suitable example. It is intended that the specification and examples be considered as exemplary only, with a true scope and spirit of the disclosure being indicated by the following claims.

What is claimed is:

1. An inflatable beach pillow, comprising:

a main body structure;

an inflatable primary air bladder located inside main body structure;

a first air valve connected to the primary air bladder and accessible from a bottom side of the main body structure;

two hooked clasps, each one being attached to an opposing side edge of the main body structure;

a pouch attached to a top edge of the main body structure;

the pouch having an opening for receiving materials located opposite a portion attached to the main body structure;

the opening of pouch comprising a plurality of rigid support bands and a closing mechanism; and two elastic bands located on opposing sides of the pouch opening.

2. The inflatable beach pillow of claim 1, wherein the plurality of rigid support bands comprises plastic bands.

3. The inflatable beach pillow of claim 1, wherein the plurality of rigid support bands comprises magnetized tape.

4. The inflatable beach pillow of claim 1, wherein the closing mechanism comprises magnetic bands.

5. The inflatable beach pillow of claim 1, wherein the closing mechanism comprises a zipper.

6. The inflatable beach pillow of claim 1, wherein the closing mechanism comprises interlocking grooves.

7. The inflatable beach pillow of claim 1, further comprising:

an integrated pocket formed between a top side of the main body structure and a top layer of fabric, the integrated pocket adapted to receive a tailor-made cooling and heating gel pack via a pocket opening located on a bottom edge of the main body structure.

8. The inflatable beach pillow of claim 1, further comprising:

an inflatable secondary air bladder located inside the main body structure; and a second air valve connected to the secondary air bladder and accessible from the top edge of the main body structure.

9. The inflatable beach pillow of claim 1, further comprising:

an inflatable secondary air bladder located underneath and attached to the main body structure; and a second air valve connected to the secondary air bladder and accessible from the top edge of the main body structure.

10. The inflatable beach pillow of claim 7, further comprising:

an inflatable secondary air bladder located inside the main body structure; and a second air valve connected to the secondary air bladder and accessible from the top edge of the main body structure.

11. The inflatable beach pillow of claim 7, further comprising:

an inflatable secondary air bladder located underneath and attached to the main body structure; and a second air valve connected to the secondary air bladder and accessible from the top edge of the main body structure.

* * * * *